US012800178B2

(12) United States Patent
Mirza-Tolouee et al.

(10) Patent No.: US 12,800,178 B2
(45) Date of Patent: Nov. 17, 2026

(54) REFRIGERANT COMPENSATION FOR REFRIGERATION SYSTEMS

(71) Applicant: TRANE INTERNATIONAL INC., Davidson, NC (US)

(72) Inventors: Changiz Mirza-Tolouee, Marietta, GA (US); Sam Sills, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 123 days.

(21) Appl. No.: 18/779,570

(22) Filed: Jul. 22, 2024

(65) Prior Publication Data

US 2025/0027672 A1 Jan. 23, 2025

Related U.S. Application Data

(60) Provisional application No. 63/514,898, filed on Jul. 21, 2023.

(51) Int. Cl.

| | |
|---|---|
| ***F24F 11/84*** | (2018.01) |
| ***F25B 41/20*** | (2021.01) |
| ***F25B 41/40*** | (2021.01) |
| ***F25B 49/02*** | (2006.01) |

(52) U.S. Cl.

CPC ..... *F24F 11/84* (2018.01); *F25B 41/20* (2021.01); *F25B 41/40* (2021.01); *F25B 49/02* (2013.01); *F25B 2700/19* (2013.01)

(58) Field of Classification Search

CPC .. F25B 2400/0411; F25B 41/20; F25B 49/02; F25B 2700/19; F24F 11/84

See application file for complete search history.

(56) References Cited

U.S. PATENT DOCUMENTS

| | | | | |
|---|---|---|---|---|
| 3,248,895 | A | 5/1966 | Mauer | |
| 3,371,500 | A | 3/1968 | Marcus, Jr. | |
| 3,859,814 | A | 1/1975 | Grant | |
| 5,526,649 | A | 6/1996 | Sada | |
| 6,279,331 | B1 * | 8/2001 | Hirota | B60H 1/00885 62/196.4 |
| 6,397,614 | B1 * | 6/2002 | Hahn | F25B 41/34 62/196.1 |
| 7,954,333 | B2 | 6/2011 | Yoshimi | |
| 8,069,682 | B2 | 12/2011 | Yoshimi et al. | |
| 9,410,727 | B1 * | 8/2016 | Boyko | F25B 41/20 |
| 9,459,032 | B2 | 10/2016 | Nishimura et al. | |
| 11,199,342 | B2 | 12/2021 | Kamitani et al. | |
| 2006/0162377 | A1 * | 7/2006 | Collings | F25B 41/39 62/527 |
| 2007/0157660 | A1 * | 7/2007 | Lee | F24F 1/06 62/198 |

(Continued)

FOREIGN PATENT DOCUMENTS

| | | |
|---|---|---|
| JP | H08-313076 A | 11/1996 |
| JP | H11-237126 A | 8/1999 |

*Primary Examiner* — Nelson J Nieves

(74) *Attorney, Agent, or Firm* — HSML P.C.

(57) ABSTRACT

A heating, ventilation, air conditioning, and refrigeration (HVACR) system includes a liquid refrigerant control valve fluidly connecting a liquid refrigerant line to a connection point downstream of an expansion device. A controller monitors a pressure or a mode change in the system, and activates the liquid refrigerant control valve to temporarily inject liquid refrigerant into the connection point downstream of the expansion device for refrigerant compensation.

20 Claims, 4 Drawing Sheets

(56) References Cited

U.S. PATENT DOCUMENTS

| | | | | |
|---|---|---|---|---|
| 2008/0098758 | A1 | 5/2008 | Moriwaki et al. | |
| 2009/0031739 | A1 | 2/2009 | Kasahara et al. | |
| 2014/0109605 | A1* | 4/2014 | Qu | F25B 49/00 62/118 |
| 2015/0323225 | A1* | 11/2015 | Matsumoto | F25B 49/02 62/324.1 |
| 2016/0209084 | A1 | 7/2016 | Kawano et al. | |
| 2017/0102175 | A1* | 4/2017 | Chen | F25B 41/20 |
| 2017/0159982 | A1* | 6/2017 | West | F25B 49/02 |
| 2017/0241688 | A1* | 8/2017 | Takeichi | F25B 13/00 |
| 2019/0195539 | A1* | 6/2019 | Akaiwa | F25B 41/26 |
| 2020/0283665 | A1* | 9/2020 | Aydin | F25B 9/008 |
| 2021/0148608 | A1* | 5/2021 | Gao | F24F 5/0035 |
| 2023/0064581 | A1* | 3/2023 | Sloan | F25B 41/385 |
| 2024/0200688 | A1* | 6/2024 | El Chammas | F25B 5/02 |
| 2024/0401890 | A1* | 12/2024 | Struewing | F24F 13/30 |
| 2025/0271186 | A1* | 8/2025 | Snyder | F25B 43/003 |

* cited by examiner

REFRIGERANT COMPENSATION FOR REFRIGERATION SYSTEMS

FIELD

This disclosure relates generally to a heating, ventilation, air conditioning, and refrigeration (HVACR) system having a refrigerant circuit. More specifically, the disclosure relates to a HVACR system having a refrigerant circuit with refrigerant compensation.

BACKGROUND

A heating, ventilation, air conditioning, and refrigeration (HVACR) system may include a refrigerant circuit with a safety mechanism to protect the system from damage caused by a low refrigerant pressure. A refrigerant circuit can work by circulating refrigerant through a series of circuit components including a compressor, a condenser, an expansion valve, and an evaporator. When the refrigerant pressure in a compressor suction port/line of the refrigerant circuit drops to a low level, it may cause the compressor to run inefficiently or even shut down. To prevent these issues, many refrigeration systems are equipped with a safety mechanism, e.g., a low-pressure shutoff device to detect the pressure drop and signal the system to shut down the compressor, the so-called low-refrigerant-pressure shutoff.

SUMMARY

This disclosure relates generally to a heating, ventilation, air conditioning, and refrigeration (HVACR) system with a refrigerant compensation mechanism and a control method to prevent low-refrigerant-pressure shutoff.

Embodiments disclosed herein provide HVACR systems with refrigerant compensation mechanisms and/or control methods to prevent low-refrigerant-pressure shutoff, when there is a sudden mode or state change or a rapid pressure drop in the systems. When the refrigerant pressure from downstream of the expansion device to the compressor suction port in the system drops to a low level, the expansion device may not act immediately to adjust the working fluid flow and the associated pressure difference. The system may shut off when the pressure falls below a protection limit. Embodiments described herein can provide refrigerant compensation to effectively prevent temporary fast drop in refrigerant pressure. Embodiments described herein can temporality inject liquid refrigerant into the system until the pressure recovers.

Embodiments described herein can keep the system operating such that the system can switch from a heating mode to a cooling mode. In one example embodiment, the system can keep operating such that the system can complete certain functions such as, for example, for defrost function purpose.

Briefly, in one embodiment, the present disclosure describes a heating, ventilation, air conditioning and refrigeration (HVACR) system. The system includes a liquid refrigerant line, an expansion device having an inlet fluidly connecting to the liquid refrigerant line to receive a liquid refrigerant from the liquid refrigerant line, a liquid refrigerant control valve fluidly connecting the liquid refrigerant line and a connection point downstream of the expansion device, and a controller. The controller is configured to monitor a pressure or a mode change in the system, and activate the liquid refrigerant control valve to inject the liquid refrigerant into the connection point based on a result of the monitoring of the pressure or mode change in the system.

In another embodiment, the present disclosure describes a method for refrigerant compensation in a heating, ventilation, air conditioning and refrigeration (HVACR) system. The method includes providing a liquid refrigerant control valve fluidly connecting a liquid refrigerant line and a connection point downstream of an expansion device in the system. The expansion device has an inlet fluidly connecting to the liquid refrigerant line to receive a liquid refrigerant from the liquid refrigerant line. The method further includes monitoring a pressure or a mode change in the system, and activating the liquid refrigerant control valve to inject the liquid refrigerant into the connection point, based on a result of the monitoring.

Various advantages are obtained in exemplary embodiments of the disclosure. One such advantage is that the HVACR systems with a refrigerant compensation mechanism and a control method described herein can respond to a sudden mode/state change, or a sudden pressure drop in the system and act immediately to prevent low-refrigerant-pressure shutoff before an expansion device of the refrigeration system can catch up to adjust the refrigerant flow in the system.

Various aspects and advantages of exemplary embodiments of the disclosure have been summarized. The above Summary is not intended to describe each illustrated embodiment. Other features and aspects will become apparent by consideration of the following detailed description and accompanying drawings.

BRIEF DESCRIPTION OF THE DRAWINGS

References are made to the accompanying drawings that form a part of this disclosure and which illustrate the embodiments in which systems and methods described in this specification can be practiced.

Like reference numbers represent like parts throughout.

DETAILED DESCRIPTION

Figure 1:
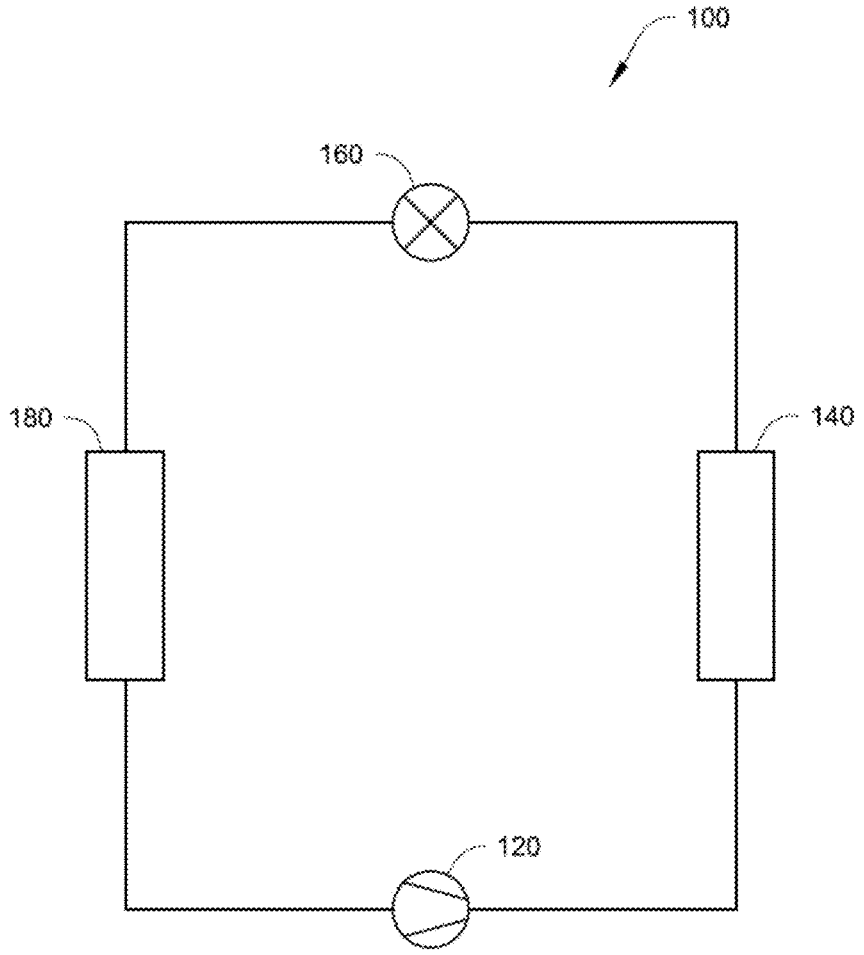
FIG. 1 illustrates a schematic diagram of a refrigerant circuit, which may be implemented in an HVACR system, according to an embodiment.

In the following Detailed Description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein. Particular embodiments of the present disclosure are described herein with reference to the accompanying drawings; however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements that may perform the same, similar, or equivalent functions.

Additionally, the present disclosure may be described herein in terms of functional block components and various processing steps. It should be appreciated that such functional blocks may be realized by any number of hardware and/or software components configured to perform the specified functions.

The scope of the disclosure should be determined by the appended claims and their legal equivalents, rather than by the examples given herein. For example, the steps recited in any method claims may be executed in any order and are not limited to the order presented in the claims. Moreover, no element is essential to the practice of the disclosure unless specifically described herein as "critical" or "essential."

Embodiments disclosed herein provide HVACR systems with refrigerant compensation mechanisms and/or control methods to prevent low-refrigerant-pressure shutoff, when there is a sudden mode or state change or a rapid pressure drop in the systems. When the refrigerant pressure in the refrigerant circuit drops to a low level, the expansion device of the refrigerant circuit may not act immediately to adjust the working fluid flow and the associated pressure difference, which may cause the refrigerant pressure to reduce fast and the system to shut off.

Instead of using a low-pressure shutoff device to shut down the compressor, embodiments disclosed herein can control the injecting of liquid refrigerant to a connection point downstream of the expansion device, which can effectively prevent temporary fast drop in refrigerant pressure.

Embodiments described herein can keep the system operating such that the system can switch from a heating mode to a cooling mode. In one example embodiment, the system can keep operating such that the system can complete certain functions such as, for example, for defrost function purpose.

FIG. 1 is a schematic diagram of a refrigerant circuit 100, according to an embodiment. The refrigerant circuit 100 includes a compressor 120, a condenser 140, an expansion device 160, and an evaporator 180. The refrigerant circuit 100 may also include a controller (e.g., controller 145 of FIG. 2) configured to control the operations of the compressor 120, the condenser 140, the expansion device 160, the evaporator 180, and/or other circuit components of the refrigerant circuit 100.

The refrigerant circuit 100 can generally be applied in a variety of systems used to control an environmental condition (e.g., temperature, humidity, air quality, or the like) in a conditioned space. The conditioned space can be a space within an office building, a commercial building, a factory, a laboratory, a data center, a residential building, or the like. In an embodiment, the refrigerant circuit 100 can be configured to be a cooling system (e.g., an air conditioning system) capable of operating in a heating mode or a cooling mode. In an embodiment, the refrigerant circuit 100 can be configured to be a heat pump that can operate in a heating/defrost mode. It is appreciated that the refrigerant circuit 100 can be configured to operate in a heating/defrosting mode and switch to a cooling mode, or operate in a cooling mode and switch to a heating/defrosting mode.

The compressor 120, the condenser 140, the expansion device 160, and the evaporator 180 can be fluidly connected. An "expansion device" as described herein may also be referred to as an expander. In an embodiment, the expansion device 160 can be an expansion valve, expansion plate, expansion vessel, orifice, or the like, or other such types of expansion mechanisms. It should be appreciated that the expansion device 160 may be any suitable type of expansion device used in the field for expanding a working fluid to cause the working fluid to decrease in pressure and temperature.

The refrigerant circuit 100 is an example and can be configured to include more or less components. For example, in an embodiment, the refrigerant circuit 100 can include other components such as, but not limited to, an economizer heat exchanger, one or more flow control devices (e.g., a valve, a pump, etc.), a receiver tank, a dryer, a suction-liquid heat exchanger, or the like.

The refrigerant circuit 100 can operate according to generally known principles. The refrigerant circuit 100 can be configured to heat and/or cool a liquid process fluid. The liquid process fluid can be a heat transfer fluid or medium (e.g., a liquid such as, but not limited to, water or the like). The refrigerant circuit 100 may be generally representative of a liquid chiller system. The refrigerant circuit 100 can alternatively be configured to heat and/or cool a gaseous process fluid (e.g., a heat transfer medium or fluid (e.g., a gas such as, but not limited to, air or the like), in which case the refrigerant circuit 100 may be generally representative of an air conditioner and/or heat pump.

In some embodiments, the refrigerant circuit 100 can operate as a vapor-compression circuit such that the compressor 120 compresses a working fluid (e.g., a heat transfer fluid such as, but not limited to, refrigerant or the like) from a relatively lower pressure gas to a relatively higher-pressure gas. The relatively higher-pressure gas is at a relatively higher temperature, being discharged from the compressor 120 and flowing through the condenser 140. In accordance with generally known principles, the working fluid flows through the condenser 140 and rejects heat to the process fluid (e.g., water, air, etc.), thereby cooling the working fluid. The cooled working fluid, which is now in a liquid form, flows to the expansion device 160 that can reduce the pressure of the working fluid. As a result, a portion of the working fluid is converted to a gaseous form. The working fluid, which is now in a mixed liquid and gaseous form flows to the evaporator 180. The working fluid flows through the evaporator 180 and absorbs heat from the process fluid (e.g., a heat transfer medium such as, but not limited to, water, a solution, air, etc.), heating the working fluid, and converting it to a gaseous form. The gaseous working fluid then returns to the compressor 120. The above-described process continues while the heat transfer circuit is operating, for example, in a cooling mode (e.g., while the compressor 120 is enabled).

In some embodiments, the refrigerant circuit 100 can be configured to operate as a free cooling/heating circuit to control one or more environmental conditions of the conditioned space. A free cooling/heating circuit can include a first heat exchanger and a second heat exchanger fluidly connected by a working fluid. The first and second heat exchangers of the free cooling/heating circuit can be dedicated heat exchangers in addition to the refrigeration circuit 100 having the compressor 120, the condenser 140, the expansion device 160, and the evaporator 180. In some embodiments, the first and second heat exchangers can share, for example, the condenser 140 and the evaporator 180 such that the refrigeration circuit 100 can operate as a free cooling/heating circuit or a vapor compression circuit.

In some embodiments, the first heat exchanger can exchange thermal energy between a working fluid and an ambient fluid (e.g., outdoor air). The first exchanger can be disposed in a location suitable to exchange thermal energy with the ambient fluid. The location can include a rooftop of the conditioned space. The second heat exchanger can be the evaporator 180 to exchange thermal energy between the working fluid and fluid in the conditioned space. Fluid in the conditioned space can, for example, be indoor air. In some embodiments, the first heat exchanger can be the condenser 140.

In a cooling operation, the first heat exchanger can release thermal energy to the ambient fluid and cool the working fluid. A pump can move the cooled working fluid to the second heat exchanger to exchange thermal energy with the fluid in the conditioned space, heating the working fluid to be cooled by the ambient fluid again. In some embodiments, in a cooling operation, the ambient fluid can have a temperature lower than the temperature of the fluid in the conditioned space. In a heating operating, the pump can circulate the working fluid between the first and the second heat exchangers to move thermal energy from the ambient fluid to the fluid in the conditioned space. In some embodiments, in a heating operation, the ambient fluid can have a temperature higher than the temperature of the fluid in the conditioned space. The working fluid can be any heat transfer fluid such as a refrigerant, water, a water solution, glycol fluid, or the like.

Figure 2:
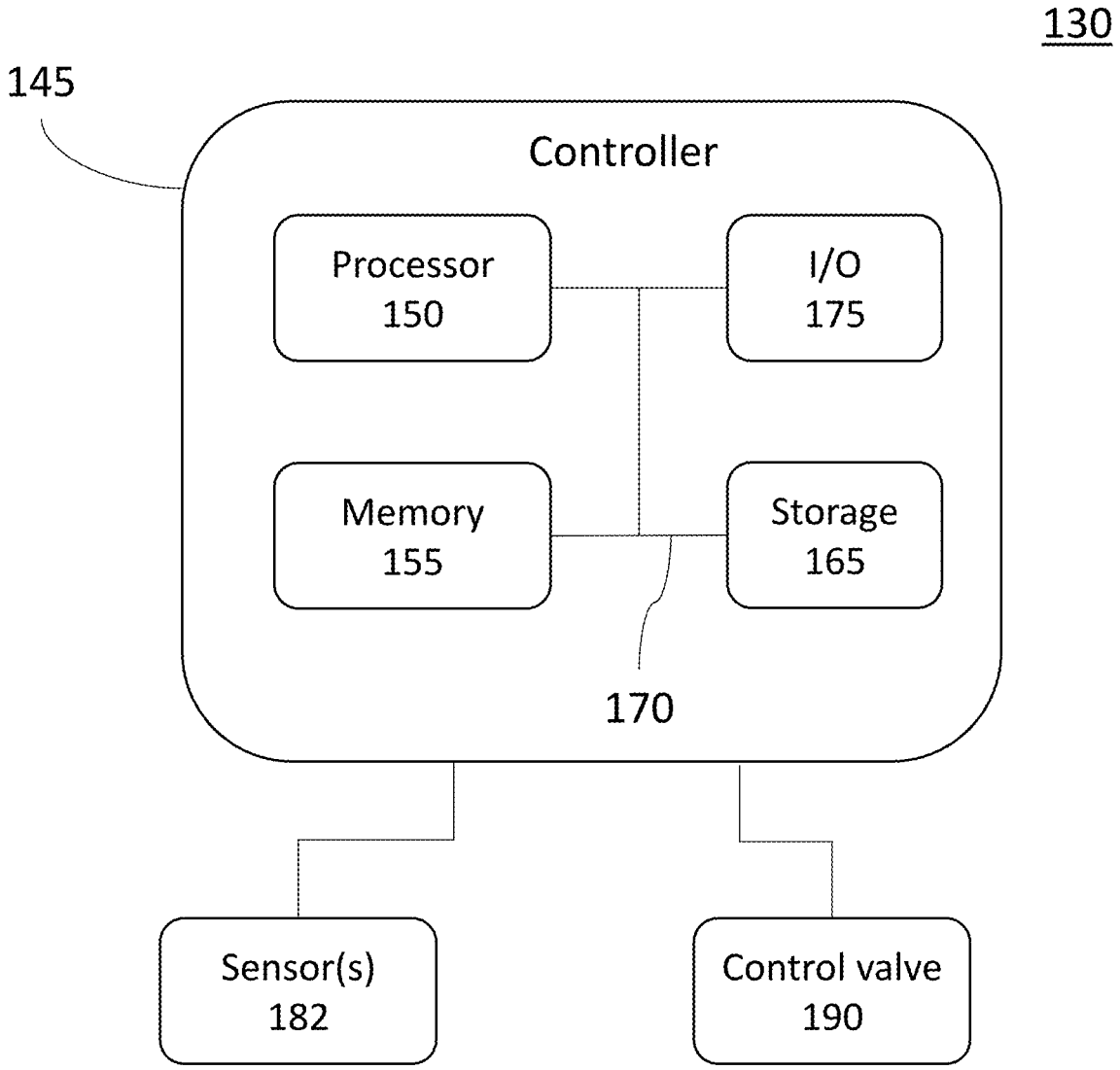
FIG. 2 is a schematic diagram of a control system, according to an embodiment.

FIG. 2 illustrates a schematic diagram of a control system 130, according to an embodiment. The control system 130 includes a controller 145 configured to control a liquid refrigerant control valve 190 such as, for example, a liquid refrigerant control valve 320 in a refrigerant circuit 300 of FIG. 3. The liquid refrigerant control valve 190 is controlled by the controller 145 and configured to inject liquid refrigerant into a connection point downstream of an expansion device such as, for example, the expansion device 160 of FIG. 1, and an expansion device 330 of FIG. 3. The operation of liquid refrigerant control valve in a refrigeration system and the associated control methods are further described in detail in embodiments depicted in FIGS. 3 and 4.

The controller 145 is generally representative of hardware aspects of a controller for the refrigerant circuit 100 (FIG. 1). The controller 145 is an example and is not intended to be limiting. The controller 145 includes a processor 150, a memory 155, input/output 175, and storage 165. It is to be appreciated that the controller 145 can include one or more additional components.

The processor 150 can retrieve and execute programming instructions stored in the memory 155 and/or the storage 165. The processor 150 can also store and retrieve application data residing in the memory 155. The processor 150 can be a single processor, multiple processors, co-processors, or a single processor having multiple processing cores. In some embodiments, the processor 150 can be a single-threaded processor. In some embodiments, the processor 150 can be a multi-threaded processor.

An interconnect 170 is used to transmit programming instructions and/or application data between the processor 150, the memory 155, the storage 165, and the input/output 175. The interconnect 170 can, for example, be one or more buses or the like.

The memory 155 is generally included to be representative of a random access memory such as, but not limited to, Static Random Access Memory (SRAM), Dynamic Random Access Memory (DRAM), Flash, suitable combinations thereof, or the like. In some embodiments, the memory 155 can be a volatile memory. In some embodiments, the memory 155 can be a non-volatile memory.

The input/output 175 can include both wired and wireless connections. In an embodiment, the input/output 175 can transmit data and/or control signals via a wire line, an optical fiber cable, or the like.

Aspects described herein can be embodied as a system, method, or computer readable medium. In an embodiment, the aspects described can be implemented in hardware, software (including firmware or the like), or combinations thereof. Some aspects can be implemented in a computer readable medium, including computer readable instructions for execution by a processor. Any combination of one or more computer readable medium(s) can be used.

The computer readable medium can include a computer readable signal medium and/or a computer readable storage medium. A computer readable storage medium can include any tangible medium capable of storing a computer program for use by a programmable processor to perform functions described herein by operating on input data and generating an output. A computer program is a set of instructions that can be used, directly or indirectly, in a computer system to perform a certain function or determine a certain result.

Examples of computer readable storage media include, but are not limited to, a floppy disk; a hard disk; a random access memory (RAM); a read-only memory (ROM); a semiconductor memory device such as, but not limited to, an erasable programmable read-only memory (EPROM), an electrically erasable programmable read-only memory (EEPROM), Flash memory, or the like; a portable compact disk read-only memory (CD-ROM); an optical storage device; a magnetic storage device; other similar device; or suitable combinations of the foregoing.

A computer readable signal medium can include a propagated data signal having computer readable instructions. Examples of propagated signals include, but are not limited to, an optical propagated signal, an electro-magnetic propagated signal, or the like. A computer readable signal medium can include any computer readable medium that is not a computer readable storage medium that can propagate a computer program for use by a programmable processor to perform functions described herein by operating on input data and generating an output.

Figure 3:
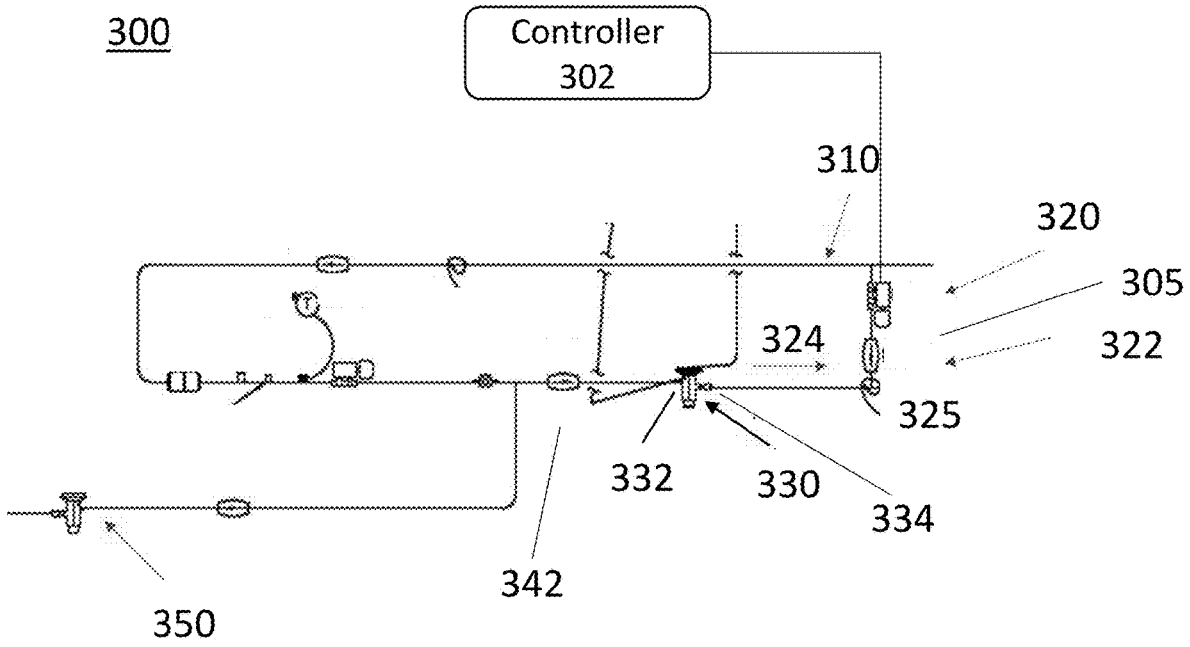
FIG. 3 is a schematic diagram of a portion of an HVACR system, according to an embodiment.

FIG. 3 is a schematic diagram of a portion of a refrigeration system 300 which may be implemented in an HVACR system, according to an embodiment. The refrigeration system 300 includes a working fluid (e.g., liquid refrigerant) line 310 connecting to an inlet 332 of an expansion device 330, which receives a liquid refrigerant from the liquid refrigerant line 330. The expansion device 330 can reduce the pressure of the working fluid and may partially vaporize the working fluid when the working fluid passes through the expansion device 330 from the inlet 332 to an outlet 334 thereof. That is, the inlet 332 is on the high pressure side, and the outlet 334 is on the low pressure side of the expansion device 330.

In an embodiment, the liquid refrigerant line 310 connects a condenser (e.g., the condenser 140 of FIG. 1, not shown in FIG. 3) to the inlet 332 of the expansion device 330. A check valve 342 is provided upstream of the inlet 332. The outlet 334 of the expansion device 330 may fluidly connect to an evaporator (e.g., the evaporator 180 of FIG. 1, not shown in FIG. 3). The expansion device 330 can regulate and adjust the amount of working fluid flow entering the evaporator and maintain the pressure difference between the condenser (high pressure side) and the evaporator (low pressure side). When there is a sudden mode or state change or a rapid pressure drop in the refrigeration system, the expansion device 330 may not act immediately to adjust the working fluid flow and the associated pressure difference, which may cause the pressure to reduce fast to shut off the system.

In the embodiment depicted in FIG. 3, a liquid refrigerant control valve 320 is provided to solve the above issues. The control valve 320 fluidly connects the liquid refrigerant line 310 and a connection point 325 downstream of the outlet 334 of the expansion device 330 as indicated by the fluid flow direction 324. When the control valve 320 is activated, the working liquid (e.g., liquid refrigerant) from the liquid refrigerant line 310 can pass through the control valve 320 to inject into the connection point 325. After the pressure recovers to a pre-determined level, the control valve 320 can be deactivated to at least partially shut off the flow of working liquid (e.g., liquid refrigerant) through the control valve 320 to the connection point 325.

The control valve 320 can be any suitable type of control valve including, for example, a motorized valve, a pneumatic valve, an on/off valve, etc. In an embodiment, the connection point 325 is upstream of an evaporator (e.g., the evaporator 180 in FIG. 1, not shown in FIG. 3). The control valve 320 can be activated to inject the working fluid into the connection point 325 to feed the evaporator. The control valve 320 may have a pre-determined orifice size to minimize liquid flooding while feeding the evaporator.

In the embodiment depicted in FIG. 3, a check valve 322 is also provided on a liquid refrigerant injection line 305, along with the liquid refrigerant control valve 320. The check valve 322 and the liquid refrigerant control valve 320 may be assembled with the liquid refrigerant injection line 305 as a pipe kit. The pipe kit can be installed in the system 300 to fluidly connect the liquid refrigerant line 310 and the connection point 325 to temporarily inject refrigerant liquid into the connection point 325. While a check valve is illustrated in the embodiment of FIG. 3, it is to be understood that other types of valves may be used along with the liquid refrigerant control valve 320 to control the flow and injection of liquid refrigerant from the liquid line 310 into the connection point 325.

The system 300 further includes a controller 302 configured to monitor a pressure or a mode change in the system 300, and activate the liquid refrigerant control valve 320 to inject the liquid refrigerant into the connection point 325 based on a result of the monitoring of the pressure of working fluid in the system and/or the mode/operation change of the system. The controller 302 can be, for example, the controller 145 of FIG. 2.

In some embodiments, the controller 302 can monitor the pressure of working fluid at a monitoring point between the expansion device 330 and a compressor suction port of a compressor (e.g., the compressor 120 in FIG. 1, not shown in FIG. 3). The pressure of working fluid at the monitoring point can be detected by a pressure sensor. The controller 302 can receive sensing data from the pressure sensor and determine whether the detected pressure is below a predetermined pressure level (e.g., a protection limit). When the detected pressure is below the protection limit, the controller 302 can instruct to activate the control valve 320 to inject the working liquid (e.g., liquid refrigerant) from the liquid refrigerant line 310 into the connection point 325. In an embodiment, the controller 302 can deactivate the liquid refrigerant control valve when the detected pressure recovers (e.g., above a predetermined pressure level). In an embodiment, the controller 302 can deactivate the control valve 320 after the control valve 320 has been activated for a period of time. The period of time can be pre-determined or adjustable. During the injection of the refrigerant liquid, the controller 302 can keep monitoring the pressure of working fluid at the monitoring point until the pressure recovers.

In some embodiments, the controller 302 can determine whether the system switches from a heating mode/operation to a cooling mode/operation. The system 300 may include various sensor(s) to monitor the temperature of working fluid in the system. For example, a temperature sensor or thermocouple can be placed at the outlet of the evaporator to monitor the temperature of refrigerant leaving the evaporator. The controller 302 can receive the sensing data to determine whether the system switches from a heating mode/operation to a cooling mode/operation. Upon the detection of the switching from the heating mode to the cooling mode, the controller 302 can instruct to activate the control valve 320 to temporally inject the working liquid (e.g., liquid refrigerant) from the liquid refrigerant line 310 into the connection point 325. As referenced herein, "temporally" refers to a predetermined period of time or a condition of which the monitored pressure recovers to a predetermined level.

Figure 4:
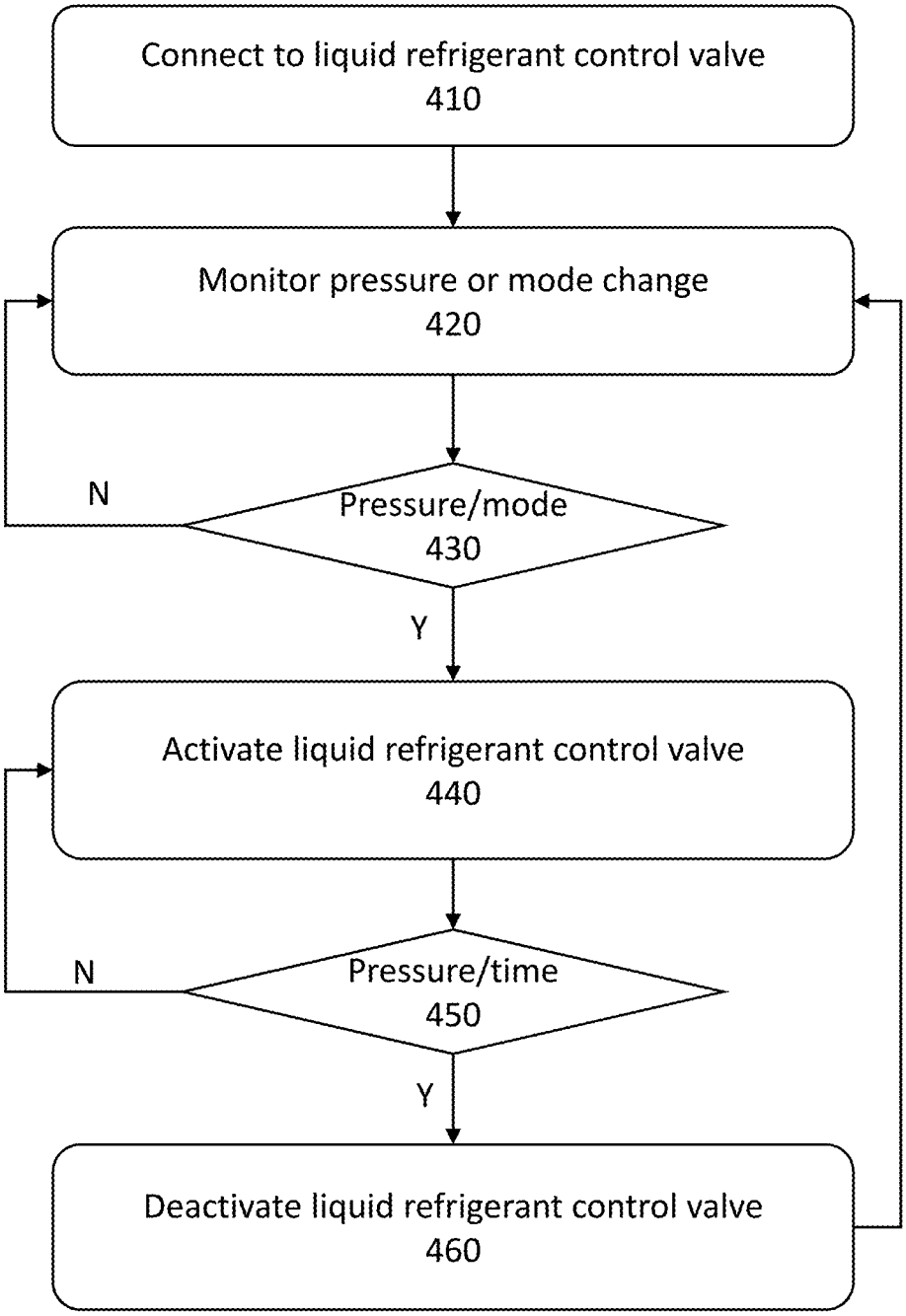
FIG. 4 is a flow diagram of a method for controlling refrigerant compensation in a HVACR system, according to an embodiment.

FIG. 4 is a flowchart of a method 400 for controlling refrigerant compensation in a HVACR system, according to an embodiment.

The flowchart 400 may include one or more operations, actions, or functions depicted by one or more blocks 410, 420, 430, 440, and 450. Although illustrated as discrete blocks, various blocks may be divided into additional blocks, combined into fewer blocks, or eliminated, depending on the desired implementation. In an embodiment, the method 400 can be performed by the control system 130 of FIG. 2, the controller 302 of FIG. 3, or any other suitable control systems or controllers.

The flowchart 400 may begin at block 410. At block 410 (Connect to liquid refrigerant control valve), the control system or controller connects to the liquid refrigerant control valve 190 or 320 of FIG. 2 or 3. The liquid refrigerant control valve is provided to fluidly connect the liquid refrigerant line 310 and the connection point 325 downstream of an expansion device in a heating, ventilation, air conditioning and refrigeration (HVACR) system. The expansion device includes the inlet 332 fluidly connecting to the liquid refrigerant line 310 to receive a liquid refrigerant from the liquid refrigerant line 310. The method 400 may proceed to block 420.

At block 420 (Monitor pressure or mode change), the control system or controller receives sensing data from various sensor(s) 182 in the HVACR system to monitor (i) a pressure of working fluid at one or more monitoring points in the system, and/or (ii) a mode change of the system. For example, the control system or controller can receive the pressure data from pressure sensors at the monitoring point (s) to monitor the refrigerant pressure, and temperature data from temperature sensors at the outlet of the evaporator to monitor the temperature of refrigerant leaving the evaporator. The method 400 may proceed to block 430.

At block 430 (Pressure/mode), the control system or controller determines (i) whether the pressure of working fluid in the system drops to a level below a predetermined first pressure level, and/or (ii) whether the system switches from a heating to a cooling mode. When the control system or controller determines that (i) the pressure of working fluid in the system drops to a level below a predetermined pressure level, or (ii) the system switches from a heating to a cooling mode, the method 400 proceeds to 440. When the control system or controller determines that (i) the pressure of working fluid in the system does not drop to a level below a predetermined pressure level, and (ii) the system does not switch from a heating to a cooling mode, the method 400 may proceed to block 420.

At block 440 (Activate liquid refrigerant control valve), the control system or controller sends instructions to the liquid refrigerant control valve 190, 320 to activate the liquid refrigerant control valve. When the control valve is activated, liquid refrigerant can be injected from the liquid refrigerant line 310 into the connection point 325 downstream of the expansion device 330 to feed a downstream evaporator. The method 400 may proceed to block 450.

At block 450 (Pressure/time), the control system or controller determines (i) whether the pressure of working fluid in the system raises to a level above a predetermined second pressure level, and/or (ii) whether the liquid refrigerant control valve 190, 320 has been activated open for a predetermined period of time. When the control system or controller determines that (i) the pressure of working fluid in the system raises to a level above a predetermined second pressure level, and/or (ii) the liquid refrigerant control valve 190, 320 has been activated open for a predetermined period of time, the method 400 may proceed to block 460. When the control system or controller determines that (i) the pressure of working fluid in the system does not raise to a level above the predetermined second pressure level, and/or (ii) the liquid refrigerant control valve 190, 320 has not been activated open for the predetermined period of time, the method 400 may proceed to block 440.

At block 460 (Deactivate liquid refrigerant control valve), the control system or controller sends control signal(s) to deactivate the liquid refrigerant control valve 190, 320, which can at least partially shut off the flow of working liquid (e.g., liquid refrigerant) through the control valve 190, 320 to the connection point 325. In an embodiment, when the control valve 190, 320 is deactivated, substantially no liquid refrigerant can be fed through the liquid refrigerant control valve 190, 320 into an evaporator downstream of the connection point 325. The expansion device(s) 330, 350 can control the amount of working fluid (e.g., refrigerant) entering the evaporator and maintain the pressure difference between the condenser and the evaporator.

ASPECTS

It is appreciated that any one of aspects 1-10 and any one of aspects 11-20 can be combined with each other.

Aspect 1. A heating, ventilation, air conditioning and refrigeration (HVACR) system comprising:
- a liquid refrigerant line;
- an expansion device having an inlet fluidly connecting to the liquid refrigerant line to receive a liquid refrigerant from the liquid refrigerant line;
- a liquid refrigerant control valve fluidly connecting the liquid refrigerant line and a connection point downstream of the expansion device; and
- a controller configured to:
  - monitor a pressure or a mode change in the system; and
  - activate the liquid refrigerant control valve to inject the liquid refrigerant into the connection point based on a result of the monitoring.

Aspect 2. The system of Aspect 1, wherein the controller is further configured to:
- monitor the pressure at a monitoring point between the expansion device and a compressor suction port; and
- determine whether the pressure is below a predetermined pressure level.

Aspect 3. The system of Aspect 1 or 2, wherein the controller is further configured to deactivate the liquid refrigerant control valve when the pressure is above a predetermined pressure level.

Aspect 4. The system of any one of Aspects 1-3, wherein the controller is further configured to deactivate the liquid refrigerant control valve after an adjustable period of time.

Aspect 5. The system of any one of Aspects 1-4, wherein the controller is further configured to detect whether the system switches from a heating mode to a cooling mode.

Aspect 6. The system of any one of Aspects 1-5, further comprising a check valve connecting to the liquid refrigerant control valve.

Aspect 7. The system of Aspect 6, wherein the check valve and the liquid refrigerant control valve are assembled as a pipe kit and positioned on a liquid refrigerant injection line connecting the liquid refrigerant line and the connection point.

Aspect 8. The system of any one of Aspects 1-9, wherein the liquid refrigerant control valve has a predetermined orifice size.

Aspect 9. The system of any one of Aspects 1-8, wherein the connection point is upstream of an evaporator.

Aspect 10. The system of any one of Aspects 1-9, further comprising a condenser to deliver the liquid refrigerant to the liquid refrigerant line.

Aspect 11. A method comprising:
- providing a liquid refrigerant control valve fluidly connecting a liquid refrigerant line and a connection point downstream of an expansion device in a heating, ventilation, air conditioning and refrigeration (HVACR) system, the expansion device having an inlet fluidly connecting to the liquid refrigerant line to receive a liquid refrigerant from the liquid refrigerant line;
- monitoring a pressure or a mode change in the system; and
- activating the liquid refrigerant control valve to inject the liquid refrigerant into the connection point, based on a result of the monitoring.

Aspect 12. The method of Aspect 11, further comprising:
- monitoring the pressure at a monitoring point between the expansion device and a compressor suction port; and
- determining whether the pressure is below a predetermined pressure level.

Aspect 13. The method of Aspect 11 or 12, further comprising deactivating the liquid refrigerant control valve when the pressure is above a predetermined pressure level.

Aspect 14. The method of any one of Aspects 11-13, further comprising deactivating the liquid refrigerant control valve after an adjustable period of time.

Aspect 15. The method of any one of Aspects 11-14, wherein further comprising detecting whether the system switches from a heating mode to a cooling mode.

Aspect 16. The method of any one of Aspects 11-15, further comprising connecting a check valve to the liquid refrigerant control valve.

Aspect 17. The method of Aspect 16, wherein the check valve and the liquid refrigerant control valve are assembled as a pipe kit and positioned on a liquid refrigerant injection line connecting the liquid refrigerant line and the connection point.

Aspect 18. The method of any one of Aspects 11-17, wherein the liquid refrigerant control valve has a predetermined orifice size.

Aspect 19. The method of any one of Aspects 11-18, further comprising feeding the liquid refrigerant from the liquid refrigerant control valve into an evaporator.

Aspect 20. The method of any one of Aspects 11-19, further comprising delivering the liquid refrigerant from a condenser to the liquid refrigerant line.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, air conditioning and refrigeration (HVACR) system comprising:

a liquid refrigerant line;

an expansion device having an inlet fluidly connecting to the liquid refrigerant line to receive a liquid refrigerant from the liquid refrigerant line;

a liquid refrigerant control valve fluidly connecting the liquid refrigerant line and a connection point downstream of the expansion device; and a controller configured to:

monitor a low pressure or a mode change in the system; and activate the liquid refrigerant control valve to inject the liquid refrigerant into the connection point based on a result of the monitoring to prevent a low-refrigerant-pressure shutoff.

2. The system of claim 1, wherein the controller is further configured to:

monitor the low pressure at a monitoring point between the expansion device and a compressor suction port; and determine whether the low pressure is below a predetermined pressure level when a pressure of the refrigerant is reduced.

3. The system of claim 1, wherein the controller is further configured to deactivate the liquid refrigerant control valve when the low pressure is above a predetermined pressure level.

4. The system of claim 1, wherein the controller is further configured to deactivate the liquid refrigerant control valve after an adjustable period of time.

5. The system of claim 1, wherein the controller is further configured to detect whether the system switches from a heating mode to a cooling mode.

6. The system of claim 1, further comprising a check valve connecting to the liquid refrigerant control valve.

7. The system of claim 6, wherein the check valve and the liquid refrigerant control valve are assembled as a pipe kit and positioned on a liquid refrigerant injection line connecting the liquid refrigerant line and the connection point.

8. The system of claim 1, wherein the liquid refrigerant control valve has a predetermined orifice size.

9. The system of claim 1, wherein the connection point is upstream of an evaporator.

10. The system of claim 1, further comprising a condenser to deliver the liquid refrigerant to the liquid refrigerant line.

11. A method comprising:

providing a liquid refrigerant control valve fluidly connecting a liquid refrigerant line and a connection point downstream of an expansion device in a heating, ventilation, air conditioning and refrigeration (HVACR) system, the expansion device having an inlet fluidly connecting to the liquid refrigerant line to receive a liquid refrigerant from the liquid refrigerant line;

monitoring a low pressure or a mode change in the system; and activating the liquid refrigerant control valve to inject the liquid refrigerant into the connection point, based on a result of the monitoring to prevent a low-refrigerant-pressure shutoff.

12. The method of claim 11, further comprising:

monitoring the low pressure at a monitoring point between the expansion device and a compressor suction port; and determining whether the low pressure is below a predetermined pressure level when a pressure of the refrigerant is reduced.

13. The method of claim 11, further comprising deactivating the liquid refrigerant control valve when the low pressure is above a predetermined pressure level.

14. The method of claim 11, further comprising deactivating the liquid refrigerant control valve after an adjustable period of time.

15. The method of claim 11, wherein further comprising detecting whether the system switches from a heating mode to a cooling mode.

16. The method of claim 11, further comprising connecting a check valve to the liquid refrigerant control valve.

17. The method of claim 16, wherein the check valve and the liquid refrigerant control valve are assembled as a pipe kit and positioned on a liquid refrigerant injection line connecting the liquid refrigerant line and the connection point.

18. The method of claim 11, wherein the liquid refrigerant control valve has a predetermined orifice size.

19. The method of claim 11, further comprising feeding the liquid refrigerant from the liquid refrigerant control valve into an evaporator.

20. The method of claim 11, further comprising delivering the liquid refrigerant from a condenser to the liquid refrigerant line.

* * * * *